US006172463B1

(12) United States Patent
Cutler et al.

(10) Patent No.: US 6,172,463 B1
(45) Date of Patent: Jan. 9, 2001

(54) INTERNALLY COOLED LINEAR ACCELERATOR AND DRIFT TUBES

(75) Inventors: Roy Ira Cutler, Plano; Warner Heilbrunn, Ovilla, both of TX (US); James Potter, Los Alamos, NM (US); Gan Li, Dallas, TX (US); Donald J. Liska, Santa Fe, NM (US)

(73) Assignee: International Isotopes, Inc., Denton, TX (US)

( * ) Notice: Under 35 U.S.C. 154(b), the term of this patent shall be extended for 0 days.

(21) Appl. No.: 09/186,533

(22) Filed: Nov. 5, 1998

(51) Int. Cl.[7] ..... H05H 9/00

(52) U.S. Cl. ..... 315/5.42; 315/505; 313/35; 313/36

(58) Field of Search ..... 315/5.41, 5.42, 315/500, 505, 35, 36

(56) References Cited

U.S. PATENT DOCUMENTS

| | | | | |
|---|---|---|---|---|
| 3,449,618 | * | 6/1969 | Gallagher | 315/5.41 X |
| 4,350,921 | * | 9/1982 | Liska et al. | 315/5.41 X |
| 5,021,741 | | 6/1991 | Kornely, Jr. et al. | 315/505 |
| 5,422,549 | * | 6/1995 | Shepard et al. | 315/5.41 X |
| 5,734,168 | | 3/1998 | Yao | 250/492.3 |

OTHER PUBLICATIONS

"Bridge coupled drift tube linacs", D. Liska, P. Smith, L. Carlisle and T. Larkin, *Elsevier Science Publishers B. V.*, Nuclear Instruments and Methods in Physics Research B79, 1993 pp. 729–731.

1979 Linear Accelerator Conference, *The Fusion Materials Irradiation Test (FMIT) Accelerator*, E. L. Kemp, D. J. Liska & M.D. Machalek, Univ.of California, Los Alamos Scientific Laboratory, pp. 21–24.

* cited by examiner

*Primary Examiner*—Benny Lee
(74) *Attorney, Agent, or Firm*—Locke Liddell & Sapp LLP

(57) ABSTRACT

A drift tube linear accelerator (DTL) incorporating an improved drift tube design, wherein the DTL comprises a resonance chamber maintaining a vacuum and having an inlet port and an exit port, an RF field source producing an oscillating radio frequency field within the chamber, and a plurality of substantially cylindrical drift tubes comprising a hollow body having a low energy end and a high energy end and housing a magnet, a low energy end cap attached to the low energy end of the hollow body and a high energy end cap attached to the high energy end of the hollow body, and a stem extending from said hollow body to an inner surface of the resonance chamber.

8 Claims, 5 Drawing Sheets

INTERNALLY COOLED LINEAR ACCELERATOR AND DRIFT TUBES

FIELD OF THE INVENTION

The present invention relates to drift tube linear accelerators for charged-particle beams, and more particularly to internally cooled drift tube designs.

BACKGROUND OF THE INVENTION

Linear accelerators are devices which accelerate charged particles along a linear path through exposure of the charged particles to time-dependent electromagnetic fields. Since the first testing of linear accelerators by Rolf Wideroe in 1928, linear accelerator technology has experienced significant advancements, perhaps most dramatically following the advancements in microwave technology experienced as a result of World War II radar research. Today linear accelerators represent a powerful tool for nuclear and elementary particle research, and also have been applied to commercial applications.

A linear accelerator delivers energy to a beam of charged particles through application of an electrical field. An early form of linear accelerator, electrostatic linear accelerators, utilize a constant electrical field to deliver energy. Each charged particle accelerated by an electrostatic linear accelerator acquires an energy equal to the product of the potential drop across the linear accelerator and the electric charge of the accelerated particle. The energy of particles is therefore measured in units called "electron volts" (eV). The ability of electrostatic linear accelerators to deliver energy to charged particles is limited by the potential difference that can be maintained by the linear accelerator.

Radio frequency (RF) linear accelerators avoid this limitation by applying a time-varying electric field within a vacuum-maintaining resonance chamber to a charged-particle beam that has been modified to: arrive in "bursts" of charged particles; and only at times in which the polarity of the electrical field is appropriate to accelerate the charged particles in the desired direction. For such a linear accelerator to properly function, the charged-particle beam must be properly phased with respect to the fields, and must maintain synchronization with the fields. Particle accelerators functioning under these principles have been termed "resonance accelerators," and come in a number of configurations, including: linacs, in which the charged particles travel in a straight line; cyclotrons, in which the charged particles travel along a spiral orbit path; and a synchrotron, in which the charged particles travel along a circular orbit path.

Drift tube linacs, or "DTLs," are one form of resonance accelerator. DTLs utilize a series of drift tubes located within a resonance chamber, and through which the charged-particle beam pass, to shield the bursts of the charged-particle beam from exposure to the time-varying electric field during times when the polarity of the field would accelerate the charged particles in a direction opposite that which is intended. Due to the shielding provided by the drift tubes, the bursts of the charged-particle beam are exposed to and accelerated by the field only during passage through the gaps between the drift tubes, and only in the intended direction. Because charged particles are accelerated during passage through each gap, the velocity of the charged particles is greater in each successive drift tube through which the particles pass. The increased velocity of the charged particles in each successive drift tube requires a commensurate increase in the length of successive drift tubes to ensure shielding of the charged particles along the entire distance traveled by the charged particles while the polarity of the accelerating field is the opposite of that desired.

Drift tubes in a DTL generally contain focusing/defocusing magnets, such as quadrupole magnets, which maintain the size and alignment of the charged-particle beam through the DTL. One side-effect of the operation of a DTL is the generation of heat within the resonance chamber and particularly within the drift tubes. This heat can cause the expansion of drift tube components and thereby modify the geometry of the drift tubes and the length of the gaps between successive drift tubes. These modifications may affect the dynamics of the charged-particle beam, including its frequency. While small perturbations in the frequency of the beam may be compensated for, significant perturbations will impair the ability of the RF field to impart energy upon the beam. Excessive heating of the drift tubes can also prove detrimental to the magnets' ability to perform its functions by altering the magnets' parameters, reducing the magnets' strength, or by introducing multipoles that may lead to emmittance growth.

Cooling systems are frequently used in conjunction with DTLs to control drift tube heating and eliminate or reduce the effects of heating on drift tube geometry and magnets. These cooling systems typically circulate a cooling fluid, such as water, through selected components of a DTL. It is known in the prior art that cooling fluid may be circulated through the stems by which drift tubes are attached to the interior wall of a DTL's resonance chamber. U.S. Pat. No. 5,021,741 to Kornely, et al., provides another example of a drift tube cooled by the circulation of a cooling fluid. Drift tube cooling becomes especially difficult in high-energy DTLs, where the accumulation of heat may be far more acute.

The manufacture of drift tubes for a DTL, however, is an expensive and difficult process. Difficulties include the high cost of drift tube materials (e.g. high purity copper), the great precision which must be exercised in construction, and the need to manufacture drift tubes in a wide variety of sizes to accommodate the varying velocities achieved by the charged particles at different points within the DTL. The already expensive and difficult manufacturing process is further exacerbated by requirements to form channels for cooling fluid flow within the drift tubes. A need exists for a drift tube design incorporating channels for cooling fluid flow which can achieve desired drift tube cooling while minimizing the difficulties of drift tube construction.

SUMMARY OF THE INVENTION

The present invention provides an improved DTL design incorporating an improved drift tube design, wherein the DTL comprises a radio frequency chamber maintaining a vacuum and having an inlet port and an exit port, an RF field source producing an oscillating radio frequency field within the chamber, and a plurality of substantially cylindrical drift tubes.

The drift tubes comprise: a stem having inlet and outlet passages extending from the stem's inner to outer ends; a substantially cylindrical hollow body interconnected to the inner end of the stem and having a high energy end and a low energy end; a substantially cylindrical magnet disposed within and substantially co-axial with the hollow body and having a magnet orifice; a high energy end cap interconnected to the high energy end of the hollow body and having a high energy orifice; a low energy end cap interconnected to the low energy end of the hollow body and having a low energy orifice; and a substantially cylindrical bore tube co-axial with the hollow body and extending from the low energy orifice through the hollow body and the magnet orifice to the high energy orifice.

The hollow body, high energy end cap, low energy end cap, and bore tube are all constructed of an electrically conductive material. The central axes of the bore tubes are oriented along an line extending from the inlet port of the chamber to the exit port of the chamber. The axial length of the drift tubes increases with each successive drift tube to accommodate the increased velocity of the charged particles. The hollow body further has a first annular cooling channel and an annular return channel, each of which are enclosed within and encircling the hollow body. The first cooling channel is connected to the inlet passage of the stem, the return channel is connected to the outlet passage of the stem, and the return channel is connected to the first cooling channel through a collecting channel located on a side of said hollow body substantially opposite the inner end of the stem.

During operation of the DTL cooling fluid travels into the chamber and through the inlet passage of the stem to the first cooling channel, through the first cooling channel to the collecting channel, through the collecting channel to the return channel, and through the return channel to the outlet passage of the stem.

BRIEF DESCRIPTION OF THE FIGURES

The objects and advantages of the present invention described above will be more clearly understood when considered in conjunction with the accompanying drawings, in which.

DETAILED DESCRIPTION OF THE PREFERRED EMBODIMENTS

Figure 1:
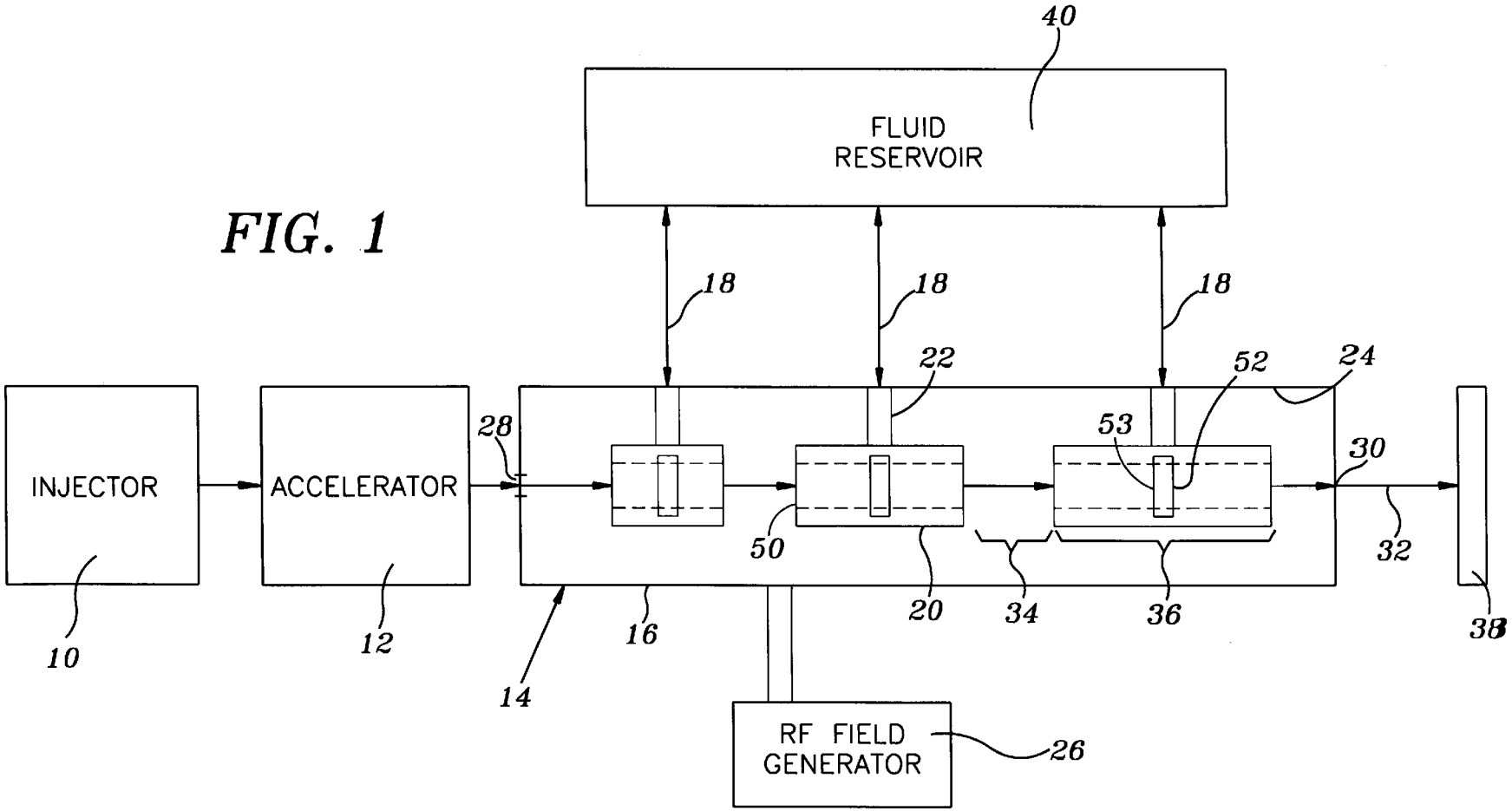
FIG. 1 is a generalized diagrammatic illustration of a drift tube linear accelerator of the present invention.

FIG. 1 is a generalized representation of a DTL system. The system begins with a charged-particle injector 10 which extracts charged particles (e.g. H+ions) from a charged-particle source and injects the extracted charged particles into a preliminary particle accelerator 12. The charged particles are accelerated by preliminary particle accelerator 12 to a desired speed and then injected into a DTL 14. It should be noted that DTL systems do not require the use of preliminary particle accelerators in all applications, though in certain applications the use of such preliminary particle accelerators is preferred. DTL 14 includes a RF field chamber 16 and a plurality of substantially cylindrical hollow drift tubes 20 located within chamber 16. Chamber 16 is maintained in a vacuum and has an inlet port 28 and an exit port 30. An RF field generator 26 produces an oscillating RF field within chamber 16 oriented to direct charged particles along a line of acceleration 32 between inlet port 28 of chamber 16 and exit port 30 of chamber 16. Each drift tube 20 is positioned within chamber 16 by a stem 22 extending from drift tube 20 to an inner surface 24 of chamber 16. Bore tubes 50 co-axial with drift tube 20 extends through drift tubes 20 along line of acceleration 32. The direction of acceleration of charged particles along line 32 within chamber 16 is dependent upon the sign of the RF field within the chamber, which changes during the field's oscillations.

Through means known in the prior art, charged particles enter chamber 16 not as a continuous stream of charged particles, but rather as a series of "bursts" of charged particles. The entry of each "burst" of charged particles into chamber 16 is controlled to occur at a time when the RF field is oriented to accelerate charged particles toward exit port 30 of chamber 16. Drift tubes 20 are also positioned to shield each "burst" of charged particles from the RF field during the time when the RF field is oriented to accelerate charged particles toward inlet port 28. In this way, the charged particles are accelerated by the RF field only as the particles pass through gaps 34 between successive drift tubes 20 (or between a drift tube 20 and a port 28 or 30) and only in the direction of exit port 30. The lengths 36 of drift tubes 20 are controlled to ensure shielding of charged particles during the entire period in which the oscillating RF field would accelerate the charged particles toward inlet port 28. Because the speed of charged particles increases with the traversing of each gap 34 between adjacent drill tubes 20, length 36 increases with each successive drift tube 20 between inlet port 28 and exit port 30.

Upon exiting chamber 16 and DTL 14, the charged particles are directed toward and impact a target 38. In certain applications, additional linear accelerators (or some other form of accelerator) and/or beam transport systems may be utilized between DTL 14 and target 38.

Figure 4:
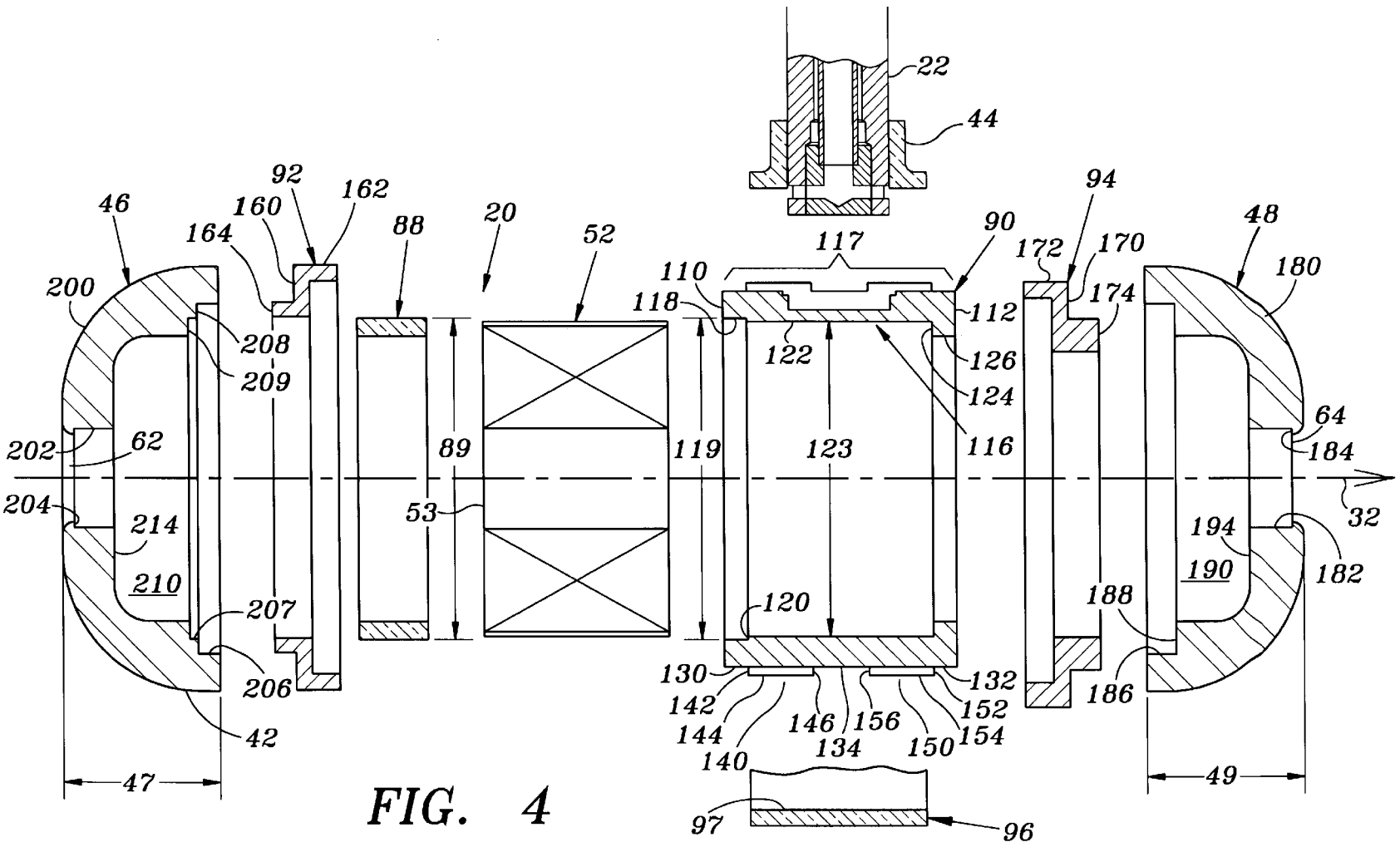
FIG. 4 is a cross-sectional disassembled side view of a drift tube of the present invention taken along line 4—4 of FIG. 2.

Each drift tube 20 houses a cylindrical focusing/defocusing magnet 52 having a cylindrical magnet orifice 53 (see FIG. 4). The central axes of magnet 52 and magnet orifice 53 are substantially co-linear with line of acceleration 32. Magnet 52 serves to maintain the size and alignment of the charged-particle beam as the beam passes through DTL 14. One side-effect of the operation of DTL 14 is the generation of heat within chamber 16 and particularly within drift tubes 20. This heat or the absence of this heat can cause expansion or contraction of drift tube 20 components and thereby modify the geometry of drift tube 20 and the length of gaps 34 between successive drift tubes 20. These modifications may affect the dynamics of the charged-particle beam, such as beam frequency. While small perturbations in the frequency of the beam may be compensated for, significant perturbations will impair the ability of the RF field to impart energy upon the beam and negatively impact DTL 14 performance. The heat can also prove detrimental to the performance of magnets 52, through the alteration of magnet parameters, the reduction of magnetic strength, or the introduction of multipoles leading to emittance growth. The present invention utilizes a cooling fluid 18 flowing from a cooling fluid reservoir 40 through stems 22 and around drift tubes 20 (and thereafter returning to reservoir 40 through stems 22) to regulate the temperature of drift tubes 20 when DTL 14 is in operation. Cooling fluid 18 is preferably water so as to limit cooling costs and minimize the dangers associated with more volatile or toxic cooling fluids. Magnet 52 is preferably a samarium cobalt quadrupole magnet stabilized at 100 degrees Celsius. The flow of cooling fluid 18 should be sufficient to minimize changes in drift tube 20 geometry and prevent the temperature of magnets 52 from exceeding 100 degrees Celsius.

Figure 2:
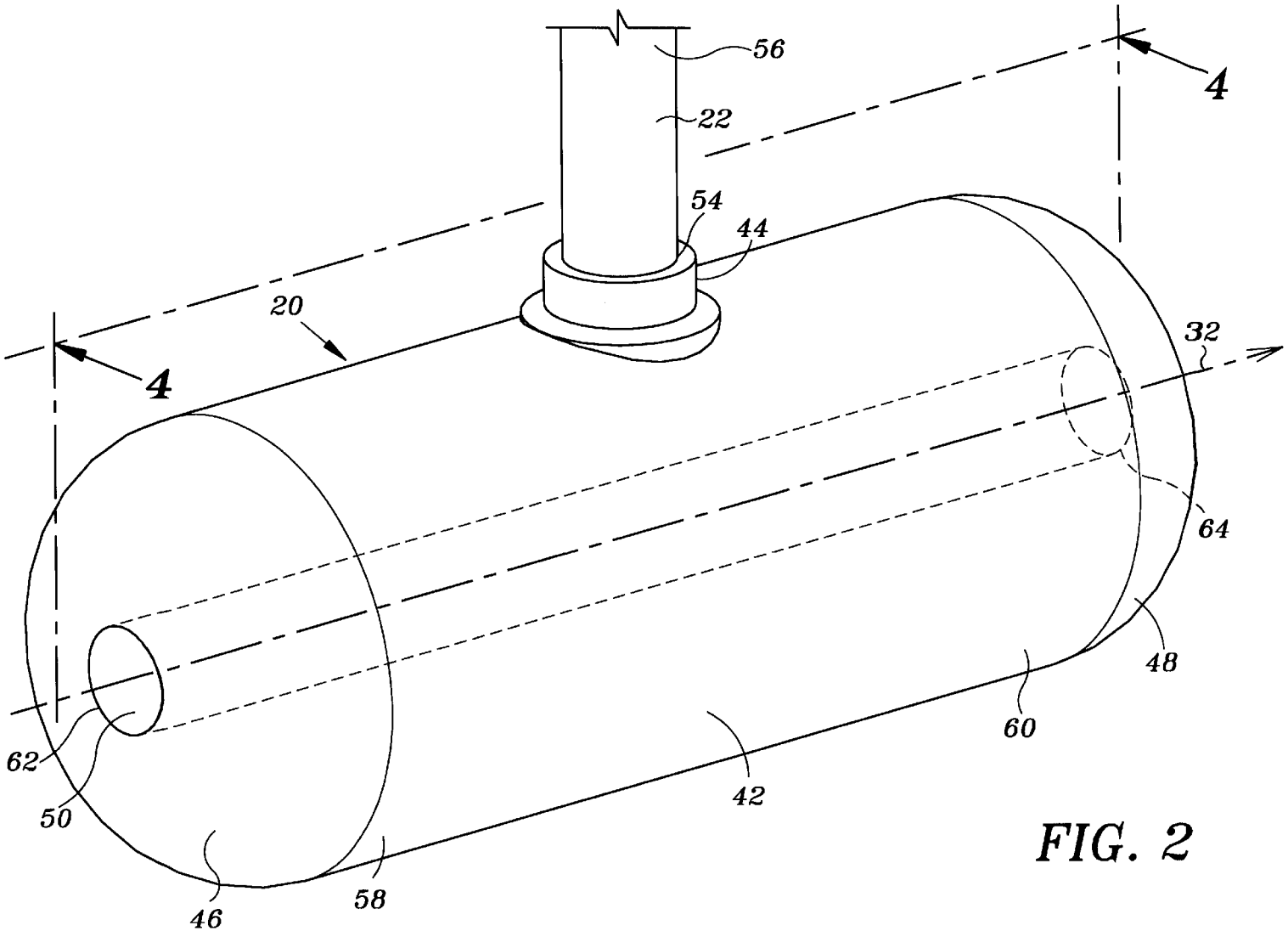
FIG. 2 is a perspective view of a drift tube of the present invention.

FIG. 2 is a perspective view of a drift tube 20 of the present invention. Drift tube 20 comprises a substantially cylindrical stem 22 (see also FIG. 5), a hollow substantially cylindrical body 42, a substantially cylindrical chimney 44 (see also FIG. 3), a low energy end cap 46, a high energy end cap 48, a bore tube 50 (see also FIG. 3), and a hollow substantially cylindrical magnet 52 (magnet 52 is not illustrated in FIG. 2, but is illustrated in FIG. 4). Stem 22 has an inner end 54 and an outer end 56. Outer end 56 of stem 22 extends through inner surface 24 of chamber 16 (as illustrated in FIG. 1). Chimney 44 extends outwardly from body 42 and interconnects with inner end 54 of stem 22. Body 42 has a energy end 58 and a high energy end 60. Low energy end cap 46 interconnects with low energy end 58 of body 42 and high energy end cap 48 interconnects with high energy end 60 of body 42. Bore tube 50 extends from a low energy orifice 62 (see also FIG. 3)in low energy end cap 46 through body 42 to a high energy orifice 64 in high energy end cap 48. Drift tube 20 is positioned so that bore tube 50 is co-axial with body 42 and is parallel to line of acceleration 32, with low energy end cap 46 oriented toward inlet port 28 of chamber 16 (illustrated in FIG. 1).

Figure 3:
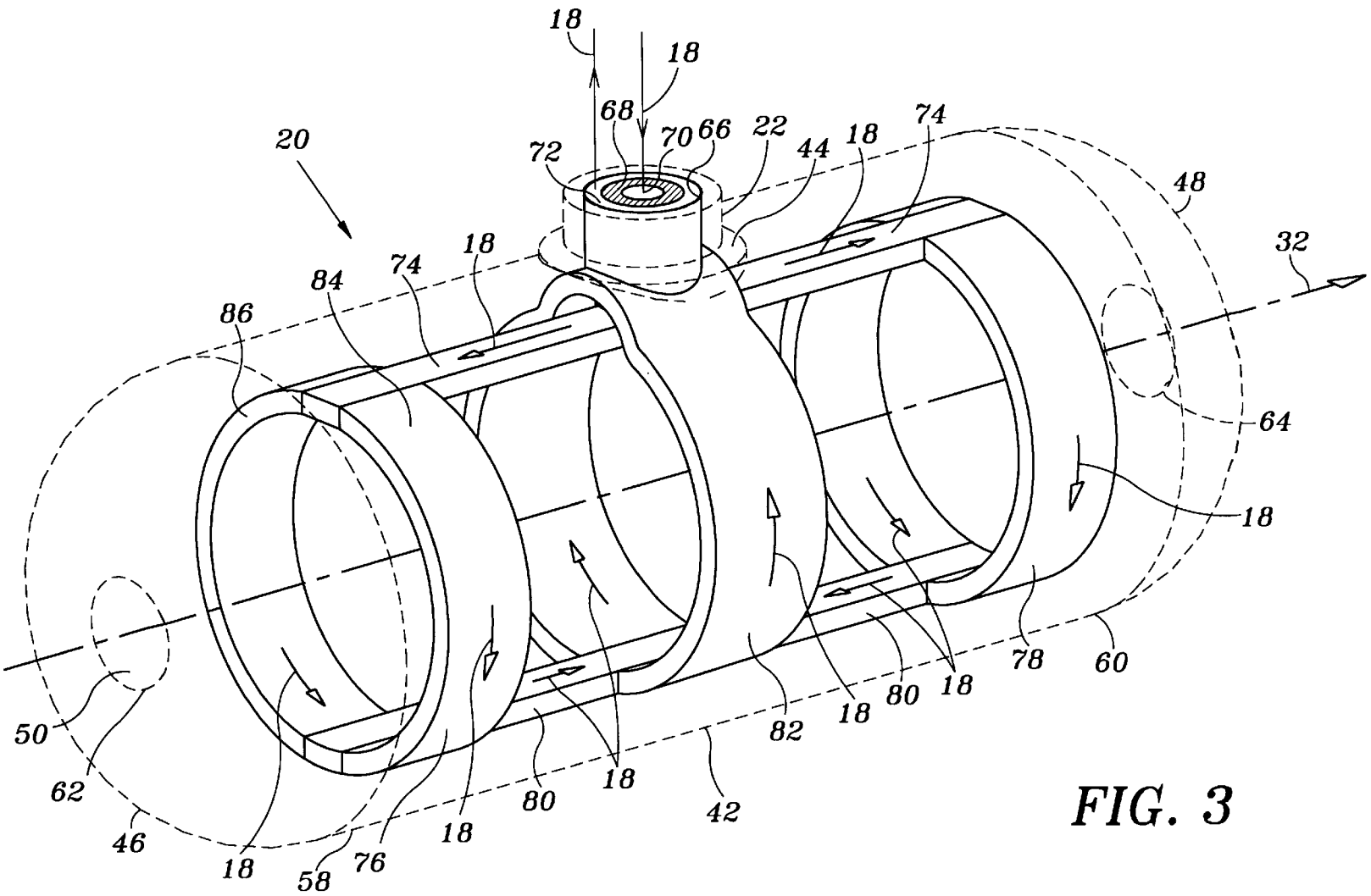
FIG. 3 is a perspective view of a drift tube of the present invention illustrating cooling fluid channels and directions of cooling fluid flow.

Now referring to FIG. 3, there is shown a perspective view of the series of cooling fluid 18 channels and passages through drift tube 20 (wherein the channels and passageways are illustrated as solid figures and the general outline of drift tube 20, cynlindrical chimney 44, bore tube 50, and low energy orifice 62 are illustrated with broken lines) together with indications of the direction of cooling fluid flow within those passages and channels. Stem 22 is hollow and has an inner stem surface 66. An inner tube 68 is located coaxially with and within stem 22. The hollow interior of inner tube 68 forms an inlet passage 70 through which cooling fluid 18 may enter chamber 16 and be introduced into drift tube 20 as shown in FIG. 1. The area between inner tube 68 and inner stem surface 66 forms an outlet passage 72 through which cooling fluid 18 may exit drift tube 20 and chamber 16 as shown in FIG. 1. It should be understood that this arrangement of inlet and outlet passages is not a requirement of this invention. Other acceptable arrangements include having an outlet passage located toward the interior of stem 22 and surrounded by a co-axially oriented inlet passage; or having an inlet passage adjacent to but not co-axial with an outlet passage within stem 22.

Still referring to FIG. 3, inlet passage 70 terminates in a disbursing channel 74 having a substantially rectangular cross-section and extending parallel to line of acceleration 32 and towards low energy end cap 46 and high energy end cap 48 of body 42. Disbursing channel 74 terminates in a first annular cooling channel 76 in low energy end 58 of body 42 near low energy end cap 46 and a second annular cooling channel 78 in high energy end 60 of body 42 near high energy end cap 48. First annular cooling channel 76 is substantially rectangular in cross-section and encircles body 42 to form a cylinder having a central axis substantially co-linear with line of acceleration 32. Second annular cooling channel 78 also is substantially rectangular in cross-section and encircles body 42 to form a cylinder having a central axis substantially co-linear with line of acceleration 32. Collecting channel 80 is of a substantially rectangular cross-section and extends from first annular cooling channel 76 to second annular cooling channel 78. Collecting channel 80 is substantially parallel to line of acceleration 32 and disbursing channel 74, and is located on the side of body 42 substantially opposite disbursing channel 74.

Annular return channel 82 is located within body 42 intermediate of first annular cooling channel 76 and second annular cooling channel 78. Annular return channel 82 is substantially rectangular in cross-section and has a cross-sectional area approximately equal to the sum of the cross-sectional area of first annular cooling channel 76 and the cross-sectional area of second annular cooling channel 78. Annular return channel 82 encircles body 42 to form a cylinder having a central axis substantially co-linear with line of acceleration 32. Annular return channel 82 connects with collecting channel 80 and with outlet passage 72. Annular return channel 82 is preferably located midway between high energy orifice 64 and low energy orifice 62, and the distance between low energy orifice 62 and first annular cooling channel 76 is preferably equal to the distance between high energy orifice 64 and second annular cooling channel 78, so as to evenly distribute the cooling capability of cooling fluid 18 flowing through channels 76, 78 and 82.

The flow of cooling fluid 18 within the channels and passages of body 42 may be summarized as follows: cooling fluid 18 travels through inlet passage 70 to disbursing channel 74; through disbursing channel 74 to first annular cooling channel 76 and second annular cooling channel 78; through first annular cooling channel 76 and second annular cooling channel 78 to collecting channel 80; through collecting channel 80 to return channel 82; and through return channel 82 to outlet passage 72, from which cooling fluid 18 exits drift tube 20. The flow of cooling fluid 18 through first cooling channel 76 is approximately equal to the flow of cooling fluid 18 through second cooling channel 78.

For the purposes of this invention, to flow "through" an annular channel means to flow from the entry point of the annular channel to the exit point of the annular channel by all available routes. For example, to flow "through" first cooling channel 76 means to flow from dispersing channel 74 to collecting channel 80 through both first semi-annular 84 and second semi-annular cooling channel 86. To flow "through" second cooling channel 78 and return channel 82 implies a similar flow pattern.

The location of first cooling channel 76 and second cooling channel 78 within low and high energy ends 58 and 60 respectively, and near low and high energy end caps 46 and 48 respectively, advantageously facilitates the cooling of low and high energy end caps 46 and 48 without utilization of cooling channels within end caps 46 and 48.

Figure 5:
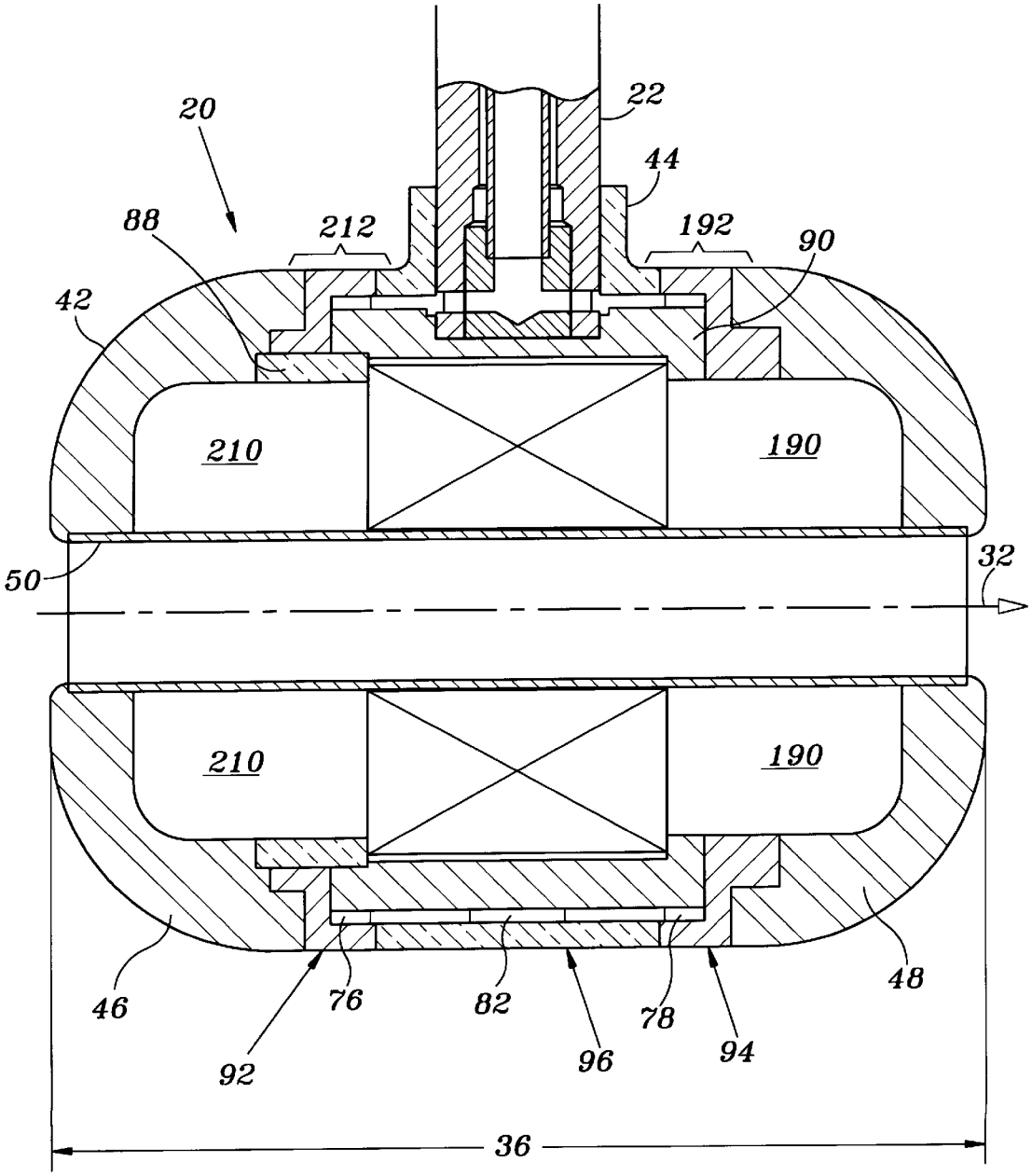
FIG. 5 is a cross-sectional assembled side view of a drift tube of the present invention taken along line 4—4 of FIG. 2.

Now referring to FIGS. 4 and 5, there are shown cross-sectional views taken through line 4—4 of FIG. 2 illustrating the particular components through which the preferred embodiment of s drift tube 20 is constructed, and the co-axial alignment of a bore tube 50 (see FIG. 5), magnet orifice 53 (see FIG. 4), magnet 52, and body 42. FIG. 4 specifically provides an exploded cross-sectional view of drift tube 20, and FIG. 5 provides an cross-sectional view of an assembled drift tube 20 including stem 22. Hollow cylindrical body 42 comprises a substantially cylindrical inner shell 90, a low energy Z-ring 92, a high energy Z-ring 94, a hollow spacer cylinder 88, and a substantially cylindrical cover 96. Low and high energy Z-rings 92 and 94, cover 96, shell 90, spacer 88, and chimney 44 are preferably constructed of copper, as are low and high energy end caps 46 and 48. When these elements are constructed from copper, and cooling fluid 18 (see FIG. 1) is water, the flow rates of cooling fluid 18 within channels 74, 76, 78, 80 and 82 (see FIG. 3) should be limited to less than 10 feet per second to avoid erosion/corrosion of the elements.

As shown in FIG. 4, inner shell 90 has a low energy side wall 110 and a high energy side wall 112, an inner surface 116 and an outer surface 117. From the low energy side wall 110 to the high energy side wall 112, inner surface 116 comprises a spacer contacting surface 118, a first shell shoulder 120, a magnet contacting surface 122, a second shell shoulder 124, and a vacuum contacting surface 126. Contacting surfaces 118, 122, and 126 are all substantially parallel to line of acceleration 32. The lengths of vacuum contacting surface 122 and spacer contacting surface 118 when measured parallel to line of acceleration 32 are about equal, as are the lengths of magnet 52 and magnet contacting surface 122 when measured parallel to line of acceleration 32. In assembling drift tube 20 magnet 52 is inserted into inner shell 90 and along magnet contacting surface 122 from the direction of low energy end cap 46 until magnet 52 abuts second shell shoulder 124. The diameter 123 of the cylinder formed by magnet contacting surface 122 is controlled to ensure a tight engagement between magnet 52 and magnet contacting surface 122. Spacer 88 is then inserted into inner shell 90 and along spacer contacting surface 118 from the direction of low energy end cap 46 until spacer 88 abuts first shell shoulder 120 and magnet 52. The diameter 119 of the cylinder formed by spacer contacting surface 118 and the outer diameter 89 of spacer 88 are controlled to ensure a tight engagement between spacer 88 and spacer contacting surface 118.

The insertion of magnet 52 into inner shell 90 along magnet contacting surface 122 may be difficult due to the intended tight tolerances between the two elements. It should be understood that shoulders 120 and 124 and spacer 88 are not required elements of the present invention, and that magnet 52 may also engage inner surface 116 of inner shell 90 solely through friction or through a third method. However, the use of spacer 88 is preferred in that spacer 88 permits magnet 52 to be locked into place between two physical barriers (spacer 88 and second shell shoulder 124), and the use of spacer 88 reduces the difficulty of inserting magnet 52 into inner shell 90 by reducing the distance over which magnet 52 must be slid, while in contact with inner surface 1 16 of inner shell 90, before reaching its desired position.

Outer surface 117 comprises a first channel surface 130, a second channel surface 132, and a return channel surface 134. A first elevated ring 140 having a first side surface 142, a cover contacting surface 144 and a return side surface 146 substantially encircles outer surface 117 intermediate of first channel surface 130 and return channel surface 134. Similarly, a second elevated ring 150 having a second side surface 152, a cover contacting surface 154, and a return side surface 156 substantially encircles outer surface 117 intermediate of second channel surface 132 and return channel surface 134. First and second elevated rings 140 and 150 may not completely encircle outer surface 117 due to the presence of chimney 44 and stem 22, under which first and second elevated rings 140 and 150 may not extend. Channel surfaces 130, 132, and 134 and cover contacting surfaces 144 and 154 are all substantially parallel to line of acceleration 32. The lengths of first channel surface 130 and second channel surface 132 are about equal when measured parallel to line of acceleration 32, and are each about one-half the length of return channel surface 134 when measured parallel to line of acceleration 32 (see FIG. 5).

When drift tube 20 is assembled, cover 96 is disposed over and engages cover contacting surfaces 144 and 154. Inner surface 97 of cover 96, return side surfaces 146 and 156, and return channel surface 134 thereby form annular return channel 82 (see FIG. 5). Cover 96 preferably engages cover contacting surfaces 144 and 154 through brazing in which a copper-gold alloy brazing material is utilized.

Low energy Z-ring 92 comprises a central element 160, an outer flange 162 extending parallel to line of acceleration 32 and toward cover 96, and an inner flange 164 extending parallel to line of acceleration 32 and toward low energy end cap 46. When assembled outer flange 162 of low energy Z-ring 92 abuts cover 96 and chimney 44 and contacts cover contacting surface 144 of first elevated ring 140; central element 160 of low energy Z-ring 92 abuts low energy side wall 110; and inner flange 164 contacts spacer 88. First cooling channel 76 (see FIG. 5) is thereby defined by first channel surface 130, first side surface 142, and central element 160 and outer flange 162 of low energy Z-ring 94.

Similarly, high energy Z-ring 94 comprises a central element 170, an outer flange 172 extending parallel to line of acceleration 32 and toward cover 96, and an inner flange 174 extending parallel to line of acceleration 32 and toward high energy end cap 48. When assembled outer flange 172 of high energy Z-ring 92 abuts against cover 96 and chimney 44 and contacts cover contacting surface 154 of second elevated ring 150; and central element 170 of high energy Z-ring 94 abuts high energy side wall 112. Second cooling channel 78 (see FIG. 5) is thereby defined by second channel surface 132, second surface 152, and central element 170 and outer flange 172 of high energy Z-ring 94. Due to the absence of a structure comparable to spacer 88 adjacent to high energy Z-ring 94, central element 170 and inner flange 174 are larger than central element 160 and inner flange 164 of low energy Z-ring 92.

Low and high energy Z-rings 92 and 94 are preferably engaged to chimney 44, cover 96, and inner shell 90 through brazing in which a copper-gold alloy brazing material is utilized. It should be understood that the use of Z-rings, spacers, covers, and inner shells is but one method of forming the cooling channels within body 42 and that other methods of forming cooling channels within body 42 are also acceptable.

Low and high energy end caps 46 and 48 may be interconnected with body 42 and bore tube 50 (see FIG. 5) after insertion of bore tube 50 through low energy Z-ring 92, spacer 88, magnet orifice 53, inner shell 90 and high energy Z-ring 94. High energy end cap 48 has a substantially semi-spherical outer surface 180 that is pierced by centrally located high energy orifice 64. End cap 48 further has a bore tube contacting surface 182, a first shoulder 184, a z-ring contacting surface 186, and a second shoulder 188. When drift tube 20 is assembled, inner flange 174 of high energy z-ring 94 contacts z-ring contacting surface 186 and abuts second shoulder 188, and bore tube 50 contacts bore tube contacting surface 182 and abuts first shoulder 184. The interface between semi-spherical outer surface 180 and orifice 64 is rounded to aid in the prevention of electrical arcing. For similar reasons, chimney 44, cover 96, high energy z-ring 94 and end cap 48 are configured to form a smooth cylindrical surface 192 (see also FIG. 5). During operation of DTL 14 the area 190 (also see FIG. 5) between magnet 52 and inner surface 194 of end cap 48 and is exposed to vacuum.

Low energy end cap 46 has a substantially semi-spherical outer surface 200 that is pierced by centrally located high energy orifice 62. End cap 46 further has a bore tube contacting surface 202, a first shoulder 204, a z-ring contacting surface 206, a second shoulder 208, a spacer contacting surface 207, and a third shoulder 209. When drift tube 20 is assembled, inner flange 164 of low energy z-ring 92 contacts z-ring contacting surface 206 and abuts second shoulder 208; bore tube 50 contacts bore tube contacting surface 202 and abuts first shoulder 204; and spacer 88 contacts spacer contacting surface 207 and abuts third shoulder 209. The interface between semi-spherical outer surface 200 and orifice 62 is rounded to aid in the prevention of electrical arcing. For similar reasons, chimney 44, cover 96, low energy z-ring 92 and end cap 46 are configured to form a smooth cylindrical surface 212 (also see FIG. 5). During operation of DTL 14 the area 210 (also see FIG. 5) between magnet 52 and inner surface 214 of end cap 46 and is exposed to vacuum.

Low and high energy end caps 46 and 48 are preferably attached to low and high energy z-rings 92 and 94 respectively through high energy electron beam welding. Low and high energy end caps 46 and 48 are also preferably attached to bore tube 50 through high energy electron beam welding. Electron beam welding is preferred based upon the ability of electron beam welding to achieve relatively deep "penetration" and thereby achieve an integrally attached relationship between the welded elements over a greater area. An integrally attached relationship between end caps 46 and 48 and their respective z-rings 92 and 94 and bore tube 50 is preferably achieved to a depth of 100 mils. The larger area of integral attachment achieved through electron beam welding facilitates heat transfer from the end caps 46 and 48 to body 42, and helps achieve the desired cooling of drift tube 20 without resort to cooling channels located within end caps 46 and 48. The utilization of simpler end caps 46 and 48 in turn permits significant reductions in the manufacturing costs of end caps 46 and 48.

Low and high energy end caps 46 and 48 have a axial lengths 47 and 48 respectively. Axial length 47 is about equal to axial length 49. Length 36 of drift tube 20 may be increased for successive drift tubes 20 within chamber 16 by increasing axial lengths 47 and 49 while maintaining the size of hollow body 42. However, the larger axial lengths 47 and 49 become, the more difficult it becomes to cool end caps 46 and 48 using first cooling channel 76 and second cooling channel 78. In high energy DTL applications, where cooling requirements may be especially high, this difficulty in cooling end caps 46 and 48 may require the use of hollow bodies 42 of greater sizes, to reduce axial lengths 47 and 49 while maintaining desired length 36 of drift tube 20.

It should be understood that the invention is not limited to the exact details of construction shown and described herein for obvious modifications will occur to persons skilled in the art.

We claim:

1. A drift tube for use in a drift tube linear accelerator, the drift tube comprising:

a stem having an inner end, an outer end, an inlet passage and an outlet passage, wherein said inlet passage and said outlet passage extend substantially from said inner end to said outer end of said stem;

a substantially cylindrical hollow body of an electrically conductive material interconnected to said inner end of said stem and having a high energy end, a low energy end, a first side disposed adjacent said stem and a second side spaced apart from said first side, said first and second sides extending between said high and low energy ends, a first annular cooling channel located adjacent to said low energy end of said hollow body to facilitate cooling of said low energy end, a second annular cooling channel located adjacent to said high energy end of said hollow body to facilitate cooling of said high energy end, and an annular return channel disposed between said first and second annular cooling channels, said first and second cooling channels and aid return channel enclosed within and encircling said hollow body, said first and second cooling channel being connected to said inlet passage of said stem through a disbursing channel disposed adjacent to said first side of said hollow body, said return channel being connected to said outlet passage of said stem, and said return channel being connected to said first and second cooling channels through a collecting channel disposed adjacent to said second side of said hollow body, such that cooling fluid travels from said inlet passage of said stem to said first and second cooling channels via said disbursing channel, and from said first and second cooling channels to said return channel via said collecting channel and to said outlet passage of said stem from said return channel;

a substantially cylindrical magnet disposed within and substantially co-axial with said hollow body and having a magnet orifice;

a high energy end cap of an electrically conductive material interconnected to said high energy end of said hollow body and having a high energy orifice;

a low energy end cap of an electrically conductive material interconnected to said low energy end of said hollow body and having a low energy orifice;

a substantially cylindrical bore tube of an electrically conductive material extending from said low energy orifice through said hollow body and said magnet orifice to said high energy orifice; and said hollow body further includes;

a substantially cylindrical inner shell having an inner surface - an outer surface, a first end surface, and a second end surface;

a substantially cylindrical cover disposed over and engaging said outer surface of said shell to define said return channel;

a low energy Z-ring having an outer flange and an inner flange extending from a central element, said outer flange of said low energy Z-ring extending toward said magnet and said inner flange of said low energy Z-ring extending away from said magnet, wherein said outer flange and said central element of said low energy Z-ring engage said inner shell to define the first cooling channel;

a high energy Z-ring having an outer flange and an inner flange extending from a central element, said outer flange of said high energy Z-ring extending toward said magnet and said inner flange of said high energy Z-ring extending away from said magnet, wherein said outer flange and said central element of said high energy Z-ring engage said inner shell to define the second cooling channel; and wherein said high energy end cap and said low energy end cap each have a flange slot, said inner flange of said high energy Z-ring engaging said flange slot of said high energy end cap and said inner flange of said low energy Z-ring engaging said flange slot of said low energy end cap.

2. The drift tube of claim 1 wherein said high energy end cap is attached to said high energy end of said hollow body and to said bore tube through electron-beam welding to facilitate heat transfer between said high energy end cap and said high energy end of said hollow body, and wherein said low energy end cap is attached to said low energy end of said hollow body and to said bore tube through electron-beam welding to facilitate heat transfer between said low energy end cap and said low energy end of said hollow body.

3. The drift tube of claim 1 wherein said hollow body further comprises a substantially cylindrical chimney extending from said hollow body, and wherein said inner end of said stem is interconnected to said hollow body through said chimney.

4. The drift tube of claim 1 wherein said cover, said low energy Z-ring, and said high energy Z-ring are attached to said inner shell through brazing, and wherein said brazing utilizes a copper-gold alloy as a brazing compound.

5. The drift tube of claim 1 wherein said cooling fluid is water.

6. A drift tube linear accelerator for accelerating charged particles comprising:

a radio frequency chamber maintaining a vacuum and having an inlet port and an exit port;

an RF field source producing an oscillating radio frequency field within said chamber;

a plurality of substantially cylindrical drift tubes, each said drift tube comprising;

a respective stem having an inner end, an outer end, an inlet passage and an outlet passage, wherein said inlet passage and said outlet passage extend substantially from said inner end to said outer end of said corresponding stem;

a respective substantially cylindrical hollow body of an electrically conductive material connected to said inner end of said corresponding stem and having a high energy end, a low energy end, a first side disposed adjacent said corresponding stem and a second side spaced apart from said first side, said first and second sides extending between said high and low energy ends, a respective first annular cooling channel located adjacent to said low energy end of said corresponding hollow body to facilitate cooling of said low energy end, a respective second annular cooling channel located adjacent to said high energy end of said corresponding hollow body to facilitate cooling of said high energy end, and a respective annular return channel disposed between said first and second annular cooling channels, said first and second cooling channels and said return channel enclosed within and encircling said corresponding hollow body, said first and second cooling channels being connected to said inlet passage of said corresponding stem through a disbursing channel disposed adjacent to said first side of said corresponding hollow body, said corresponding return channel being connected to said outlet passage of said corresponding stem, and said return channel being connected to said first and second cooling channels through a collecting channel disposed adjacent to said second side of said hollow body, such that cooling fluid travels from said inlet passage of said corresponding stem to said first and second cooling channels via said disbursing channel, and from said first and second cooling channels to said return channel via said collecting channel to said outlet passage of said stem from said return channel;

a respective substantially cylindrical magnet disposed within and substantially coaxial with said corresponding hollow body and having a respective magnet orifice;

a respective high energy end cap of an electrically conductive material interconnected to said corresponding high energy end of said corresponding hollow body and having a respective high energy orifice;

a respective low energy end cap of an electrically conductive material interconnected to said corresponding low energy end of said corresponding hollow body and having a respective low energy orifice;

a respective substantially cylindrical bore tube of an electrically conductive material extending from said corresponding low energy orifice through said corresponding hollow body and said corresponding magnet orifice to said corresponding high energy orifice, said corresponding bore tube being co-axial with said hollow body and having a respective central axis;

wherein said central axes of said bore tubes are oriented along a line extending from said corresponding inlet port to said corresponding exit port, and each drift tube has a respective axial length, said corresponding axial length increasing for each successive drift tube to accommodate the increased velocity of said charged particles; and wherein said respective hollow body further includes:

a respective substantially cylindrical chimney extending from said corresponding hollow a respective substantially cylindrical inner shell having an inner surface, an outer surface, a first end surface, and a second end surface, said inner end of said stem being interconnected to said corresponding inner shell through said corresponding chimney;

a respective substantially cylindrical cover disposed over and engaging said outer surface of said corresponding shell to define said corresponding return channel;

a respective low energy Z-ring having an outer flange and an inner flange extending from a central element, said outer flange of said low energy Z-ring extending toward said corresponding magnet and said inner flange of said low energy Z-ring extending away from said corresponding magnet, wherein said outer flange and said central element of said low energy Z-ring engage said corresponding inner shell to define said respective first cooling channel;

a respective high energy Z-ring having an outer flange and an inner flange extending from a central element, said outer flange of said high energy Z-ring extending toward said corresponding magnet and said inner flange of said high energy Z-ring extending away from said corresponding magnet, wherein said outer flange and said central element of said high energy Z-ring engage said corresponding inner shell to define said respective second cooling channel; and wherein said corresponding high energy end cap and said corresponding low energy end cap each have a respective flange slot, said corresponding inner flange of said corresponding high energy Z-ring engaging said corresponding flange slot of said corresponding high energy end cap and said corresponding inner flange of said corresponding low energy Z-ring engaging said corresponding flange slot of said corresponding low energy end cap.

7. The drift tube linear accelerator of claim 6 wherein said respective high energy end cap is attached to said corresponding high energy end of said correspond hollow body and to said bore tube through electron-beam welding to facilitate heat transfer between said corresponding high energy end cap and said corresponding high energy end of said corresponding hollow body, and wherein said respective low energy end cap is attached to said corresponding low energy end of said corresponding hollow body and to said corresponding bore tube through electron-beam welding to facilitate heat transfer between said corresponding low energy end cap and said corresponding low energy end of said corresponding hollow body.

8. The drift tube linear accelerator of claim 6 wherein said cooling fluid is water.

* * * * *

UNITED STATES PATENT AND TRADEMARK OFFICE

CERTIFICATE OF CORRECTION

PATENT NO. : 6,172,463 B1
DATED : January 9, 2001
INVENTOR(S) : Cutler et al.

It is certified that error appears in the above-identified patent and that said Letters Patent is hereby corrected as shown below:

Column 5,
Line 13, insert -- low -- before "energy", first occurrence.
Line 17, delete "(see also FIG. 3)".

Column 8,
Line 18, delete "92" and substitute therefor -- 94 --.

Column 9,
Line 30, delete "48" and substitute therefor -- 49 --.

Column 10,
Line 32, delete "-" and substitute therefor -- , --.

Column 11,
Line 54, following "channel" insert -- and --.

Column 12,
Line 17, following "hollow" insert -- body; --.

Signed and Sealed this

First Day of January, 2002

*Attest:*

*Attesting Officer*

JAMES E. ROGAN
*Director of the United States Patent and Trademark Office*